United States Patent [19]

Sadowski et al.

[11] Patent Number: 4,979,535

[45] Date of Patent: Dec. 25, 1990

[54] UMBRELLA WITH DETACHABLE COVER

[76] Inventors: Mark H. Sadowski, 2911 Bayview Avenue #207C, Willowdale, Ontario M2K 1E8; Stephen L. Levitan, 92 King Edward Avenue, Toronto, Ontario, Canada, M4C 5J6

[21] Appl. No.: 286,105

[22] Filed: Dec. 19, 1988

[51] Int. Cl.[5] ..... A45B 15/00; A45B 25/18

[52] U.S. Cl. ..... 135/34

[58] Field of Search ..... 135/34

[56] References Cited

U.S. PATENT DOCUMENTS

| | | | |
|---|---|---|---|
| 475,072 | 5/1892 | Witt | 135/34 |
| 588,773 | 8/1897 | Mitchell | 135/34 |
| 664,123 | 12/1900 | Carmelich | 135/34 |
| 814,884 | 3/1906 | Stettner | 135/34 |
| 1,006,240 | 10/1911 | Lewis | 135/34 |
| 2,230,640 | 2/1941 | Feller | 135/34 |
| 4,061,154 | 12/1977 | Cox et al. | 135/34 |

FOREIGN PATENT DOCUMENTS

| | | | |
|---|---|---|---|
| 382123 | 11/1937 | France | 135/34 |
| 18933 | 8/1897 | United Kingdom | 135/34 |

*Primary Examiner*—Henry E. Raduazo
*Assistant Examiner*—Jerrold D. Johnson
*Attorney, Agent, or Firm*—Arne I. Fors

[57] ABSTRACT

An umbrella has a frame with a shaft and a series of ribs hingedly secured thereto for movement between a folded position and an extended position. The shaft has a tip projecting beyond the ribs, and the ribs having free end portions remote from the shaft. A cover has a central aperture receiving the shaft tip, and the cover is detachably retained in assembly with the shaft tip. The cover also has a periphery with a series of loops spaced therearound. A series of connectors are provided, each having a body with an aperture in one end detachably receiving a free end portion of a rib and a groove at an opposite end detachably receiving a loop to detachably retain the cover in place.

3 Claims, 3 Drawing Sheets

22
22a
34

16
16
28
28
16
28
20
34
17
20
20
16
28
34
18
22a
16
28
20
16
28
28
34
34
16
16
34
34
12
14

UMBRELLA WITH DETACHABLE COVER

This invention relates to umbrellas with detachable covers.

Umbrellas with detachable covers are known, an advantage being that the cover of such an umbrella can be changed when required, for example, if a cover of a different colour is desired. However, known umbrellas of this kind have rather complicated arrangements for detachably securing a cover to the umbrella frame.

It is, therefore, an object of the invention to provide an umbrella with a cover which is detachably secured to the umbrella frame in a relatively uncomplicated manner.

According to the invention, an umbrella comprises a frame having a shaft, a series of ribs hingedly secured thereto, a means for moving the ribs between a folded position and an extended position, the shaft having a tip projecting beyond the ribs and the ribs having free end portions remote from the shaft, a cover having a central aperture receiving the shaft tip, means to detachably retain the cover in assembly with the shaft tip, the cover having a periphery with a series of loops spaced therearound, and a series of connectors, each connector comprising a body with an aperture in one end detachably receiving a free end portion of a rib and a groove at an opposite end detachably securing a loop to detachably retain the cover in place.

Each connector may have an intermediate neck portion of reduced width to facilitate manual gripping by a person attaching or removing the cover.

The umbrella may also include a series of intermediate securing means spaced around the cover at intermediate positions between the periphery and the central aperture, each securing means detachably securing the cover to a rib at an intermediate position between the free end of the rib and the shaft. The means to detachably retain the cover in an assembly with the shaft tip may comprise a removable resilient ring mounted on the shaft to retain the cover between the ring and the ribs.

Figure 1:
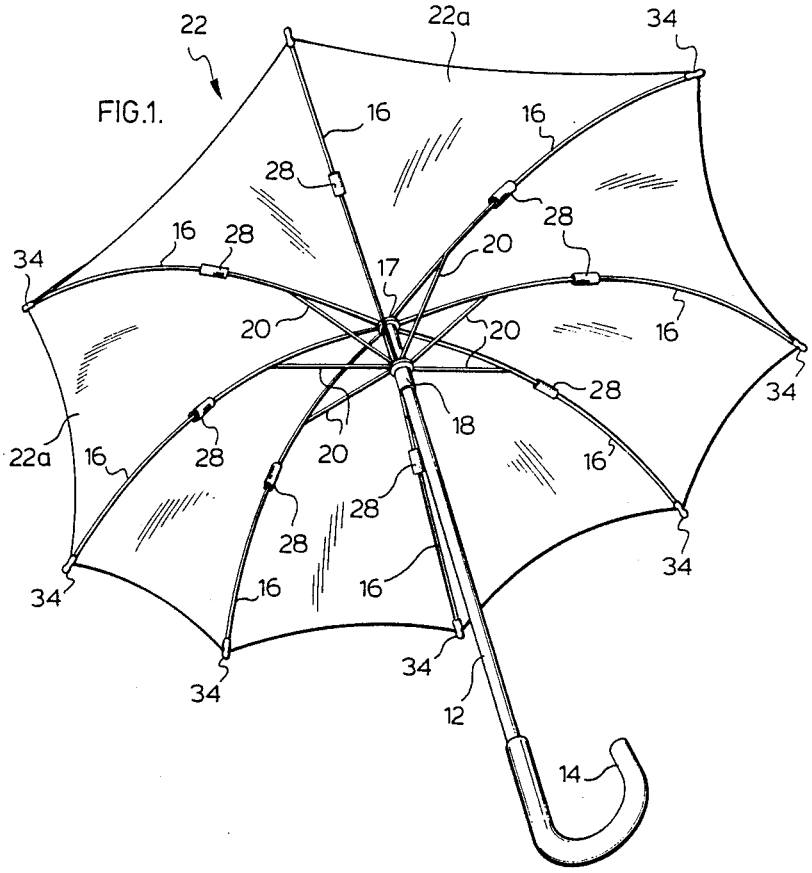
Figure 3:
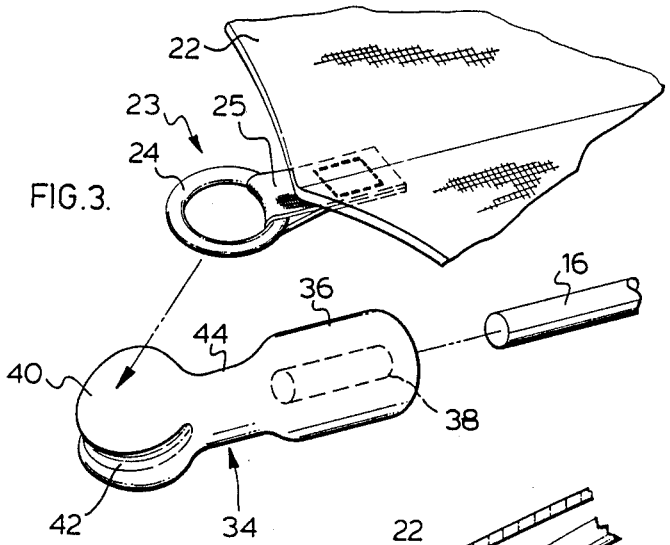
Figure 2:
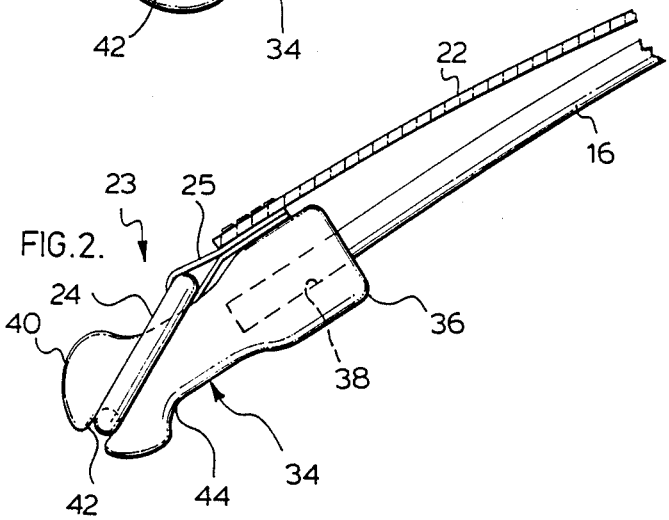
Figure 4:
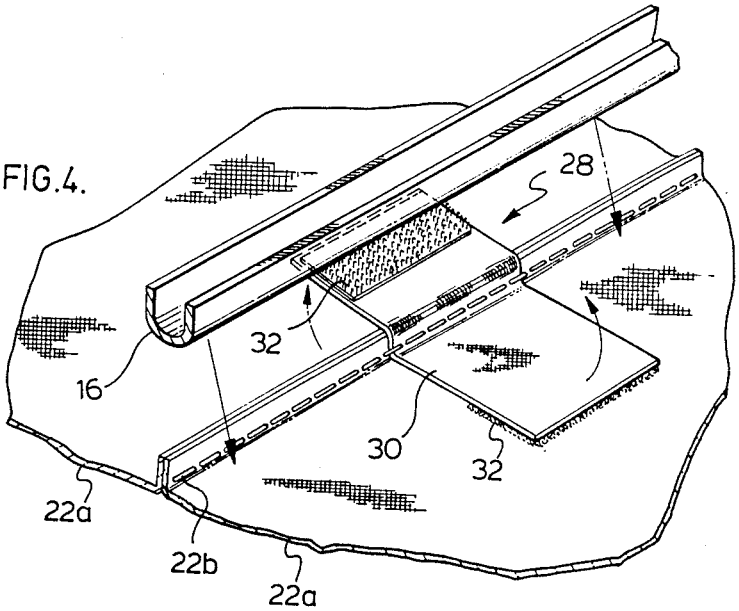
Figure 5:
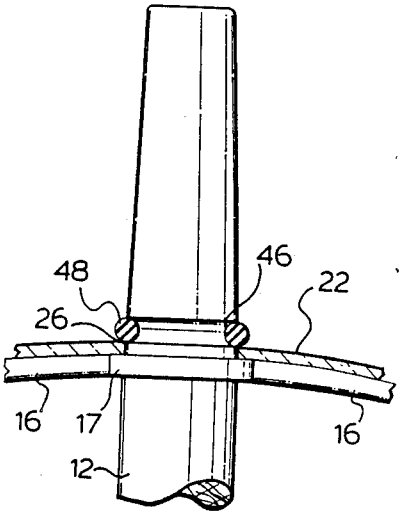

One embodiment of the invention will now be described, by way of example, with reference to the accompanying drawing of which:

FIG. 1 is a perspective view of an umbrella in accordance with the invention in an extended condition, FIG. 2 is a broken away side view showing the cover detachably secured to the free end portion of an umbrella rib by means of a loop and connector, FIG. 3 is an exploded perspective view of the parts shown in FIG. 2, FIG. 4 is a detailed sectional view of the intermediate securing means for detachably securing an intermediate portion of a cover to an intermediate portion of a rib, and FIG. 5 is a detailed sectional view showing the attachment of the cover to the shaft tip.

Referring to the drawing, an umbrella has a frame comprising a shaft 12, a handle 14, ribs 16 hingedly secured to a collar 17 secured to shaft 12, and means comprising a slider 18 mounted on the shaft 12 and struts 20 pivotally connected to slider 18 and the ribs 16 for moving the ribs 16 between folded and extended positions. The extended position is shown in FIG. 1. As so far described, the umbrella frame is conventional and, therefore, need not be described in further detail.

In accordance with the embodiment of the invention, the umbrella has a fabric cover 22 with a series of loops 23 spaced around the periphery, each loop 23 comprising a rubber ring 24 passing through the fold of a folded piece of cloth 25 sewn to the inner side of the cover 22. The cover 22 has a central aperture 26 to enable the cover 22 to be mounted on the shaft 12 as will be described in more detail later. The cover 22 is formed by a series of triangular sections **22*a* sewn together along their side edges so that the seam 22*b* is on the inside of the cover 22**.

The cover 22 also has a series of intermediate connecting means 28 spaced around the cover 22 at intermediate positions between the periphery of the cover 22 and the central aperture 26. Each intermediate connecting means 28 comprises a short strip of material 30 sewn at its mid-point to the seam **22*b*. The strip 30 has Velcro pads 32 at opposite ends and or opposite sides secured by engagement of the Velcro pads 32**.

The umbrella also has a series of connectors 34, each connector 34 comprising an elongated body of plastic or other suitable material. Each connector 34 has a cylindrical end portion 36 with a bore 38 which can receive a free end portion of a rib 16 in frictional engagement. The opposite end portion 40 of each end connector 34 has a bulbous shape with a groove 42 which extends part way around the bulbous end portion 40 to receive a ring 24. An intermediate neck portion 44 of reduced diameter extends between the bulbous end portion 40 and the cylindrical end portion 36.

The end of the shaft 12 remote from the handle 14 has an annular groove 46 just beyond the collar 17 and into which a rubber ring 48 snaps to retain the cover 22 in place.

Thus, the cover 22 is detachably secured to the frame at various positions. The shaft 12 passes through the central aperture 26 in the cover 22, so that the cover 22 is retained between the ring 48 and the collar 17. Each ring 24 is secured to the groove 42 of a connector 34 which is mounted on the free end portion of a rib 16. The depth of the groove 42 is sufficient to ensure that the ring 24 remains therein even when the umbrella is collapsed. Also, each intermediate connecting means 28 is secured to a rib 16, with the seams **22*b* extending along the length of the ribs 16**.

To remove the cover 22, therefore, it is simply necessary to remove the ring 48, remove the rings 24 from the connectors 34 and separate the Velcro pads 32 of each intermediate connecting means 28. Another cover of the same kind can then easily be fitted to the ribs 16 and the shaft This is facilitated the intermediate neck portions 44 of the connectors 34 which are readily grabbed by a person's thumb and index finger.

Various alternatives within the scope of the invention are of course possible. For example, the loops 24 may be formed by buttonholes in the cover 22 rather than by attached rings, and the rings 24 may be provided with portions extending forwardly therefrom which act as pull tabs. The intermediate connecting means 28 may be provided by a button and buttonhole or press-studs on the strips 30 instead of the Velcro-type attachment. Instead of providing a rubber ring 48, the end of the shaft 12 may be screw-threaded with a screw-threaded cap securing the cover 22 between the cap and the collar 17.

Other embodiments of the invention will be readily apparent to a person skilled in the art, the scope of the invention being defined in the appended claims.

I claim:

1. An umbrella comprising:

(a) a shaft having a handle at its rearward end and a collar at its forward end;

(b) a slider axially positioned along said shaft and cooperating with a series of radially connected hinged struts extending toward pivotally cooperating ribs, whereby axial movement of said slider pivots said ribs from a rearward folded-down position to a radially open position defining an umbrella frame;

(c) each of said ribs having a connector at its extended end with a C-shaped groove therein extending substantially parallel to the longitudinal axis of the rib;

(d) a detachable cover having a central aperture for mounting over said shaft collar, means for detachably retaining said cover on said shaft;

(e) means for detachably securing the periphery of said cover to the extended ends of said ribs, said means comprising a plurality of loops spaced around said periphery, each including a resilient ring for engagement within the (annular C-shaped groove of a cooperating rib connector to thereby extend said cover in taut engagement between said center opening and said periphery.

2. An umbrella according to claim 1 wherein each connector has an intermediate portion of reduced width to facilitate manual gripping by a person attaching or removing the cover.

3. An umbrella according to claim 1 also including a series of intermediate securing means spaced around the cover at intermediate positions between the periphery and the central aperture, each intermediate securing means detachably securing the cover to a rib at an intermediate position between the free end of the rib and the shaft.

* * * * *